United States Patent [19]

Goudis

[11] Patent Number: 4,971,246

[45] Date of Patent: Nov. 20, 1990

[54] MODULAR ROLLER COASTER TOY

[76] Inventor: Albert A. Goudis, 2246 S. W. Creekside Dr., Palm City, Fla. 34990

[21] Appl. No.: 341,858

[22] Filed: Apr. 21, 1989

[51] Int. Cl.[5] ..... E01B 23/00; A63H 33/00

[52] U.S. Cl. ..... 238/10 R; 238/10 A; 446/168

[58] Field of Search ..... 233/10 R, 10 A, 10 F, 233/10 E; 446/168, 175, 111, 85; 275/1 R, 86 C

[56] References Cited

U.S. PATENT DOCUMENTS

| | | | |
|---|---|---|---|
| 1,662,162 | 3/1928 | Nestor | 273/86 C |
| 1,714,433 | 5/1929 | Molnar | 446/168 |
| 2,000,808 | 5/1935 | Williams | 446/168 |
| 2,838,870 | 6/1958 | Morse | 446/168 |
| 3,394,489 | 7/1968 | Martin | 446/168 |
| 4,171,090 | 10/1979 | Eisenberg | 238/10 R |
| 4,319,425 | 3/1982 | Shine | 446/168 |

FOREIGN PATENT DOCUMENTS

| | | | |
|---|---|---|---|
| 144050 | 1/1919 | United Kingdom | 273/86 C |

*Primary Examiner*—Robert J. Oberleitner
*Attorney, Agent, or Firm*—Alvin S. Blum

[57] ABSTRACT

A toy assembles to provide a variably inclined trackway for rolling a ball or marble. The course of the trackway in both horizontal and vertical planes being variable by increments of fixed distances. A base has many vertical holes with modular spacing. Vertical members with lengths varying by a vertical length module fit in holes in the base. The horizontal path is chosen by selecting holes in the base. Horizontal elements with a right angle trackway segment on the upper surface fit on the vertical members. Elongate straight sloping elements with a straight trackway segment on the upper surface connect horizontal members on different levels to form a continuous trackway. Sloping elements are provided in different lengths for connecting horizontal elements that are different distances apart. The pathway can be configured for different slopes and crossing over and under itself without adjustment, special skills or tools and packs away in a small space. It may easily be made entirely of wood.

16 Claims, 4 Drawing Sheets

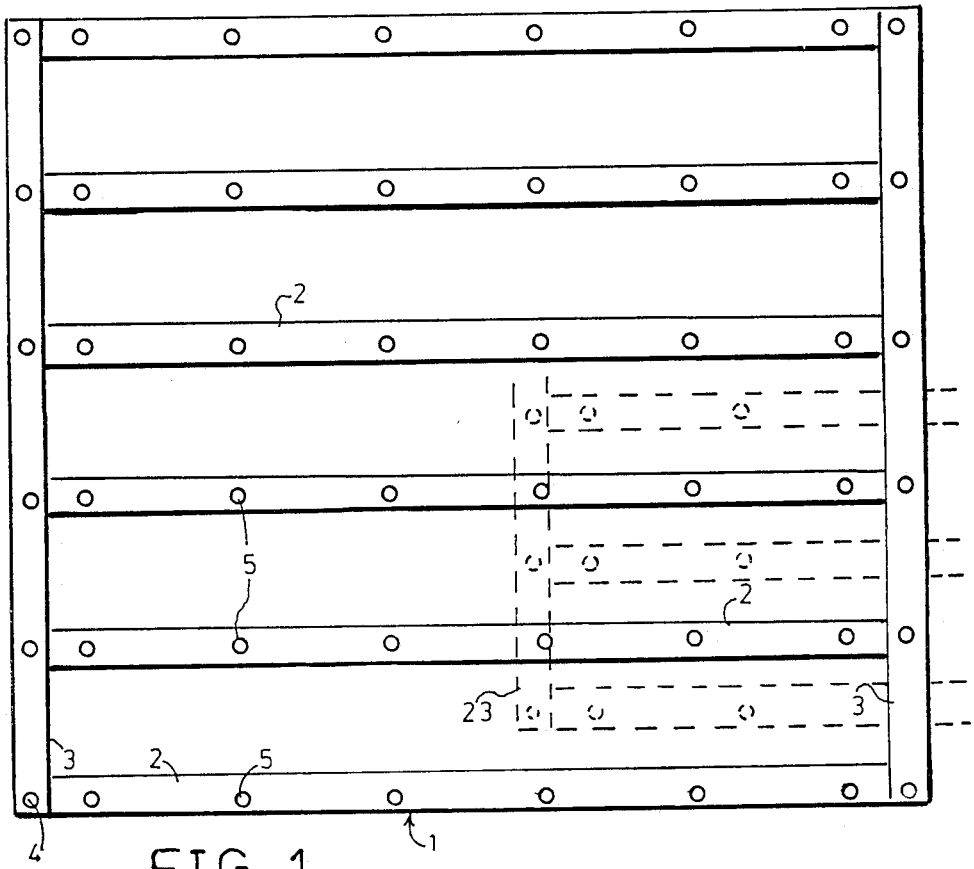
FIG. 1
FIG. 10
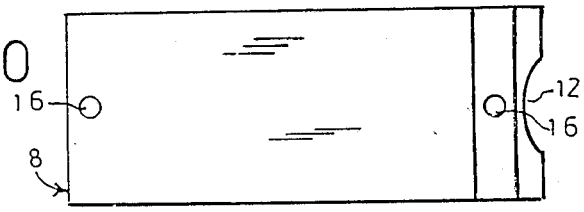

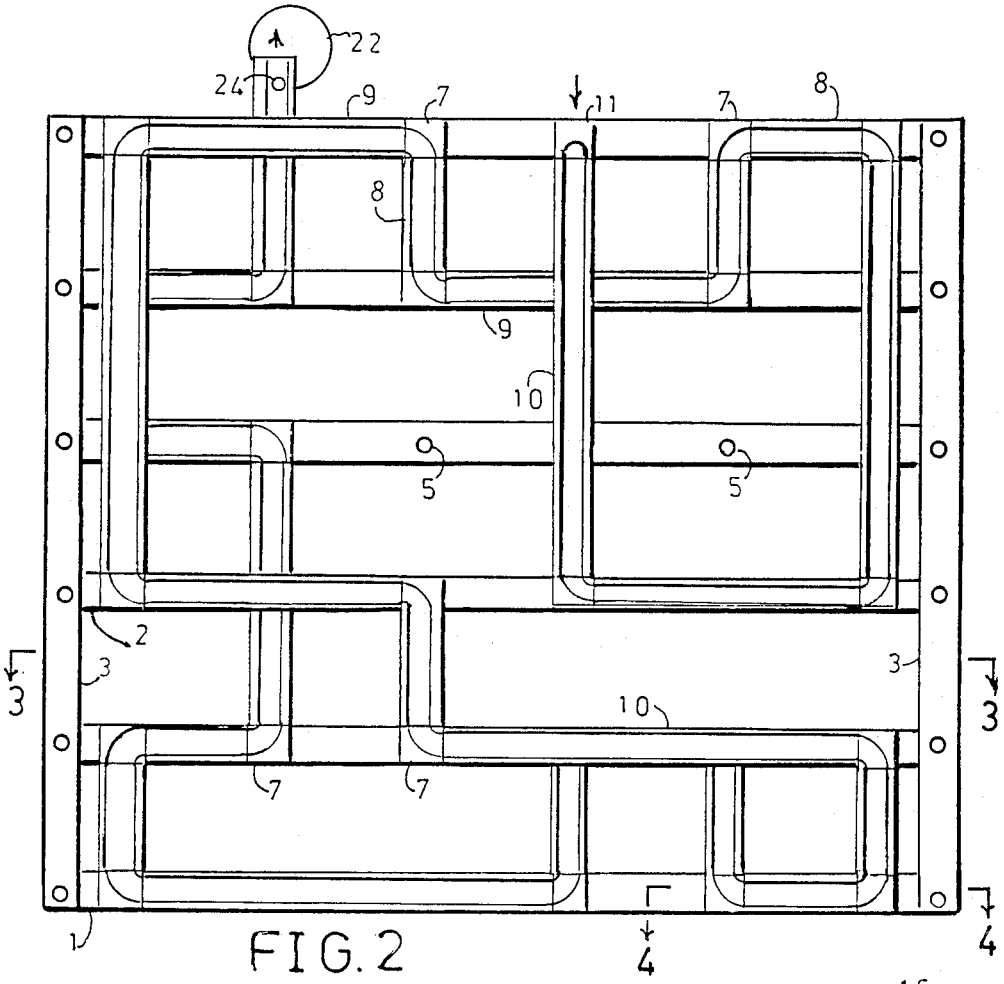
FIG. 2
FIG. 9
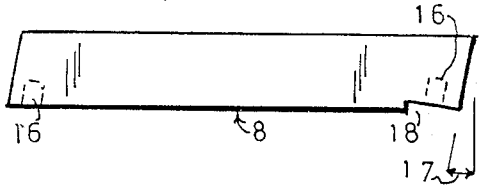

FIG. 4
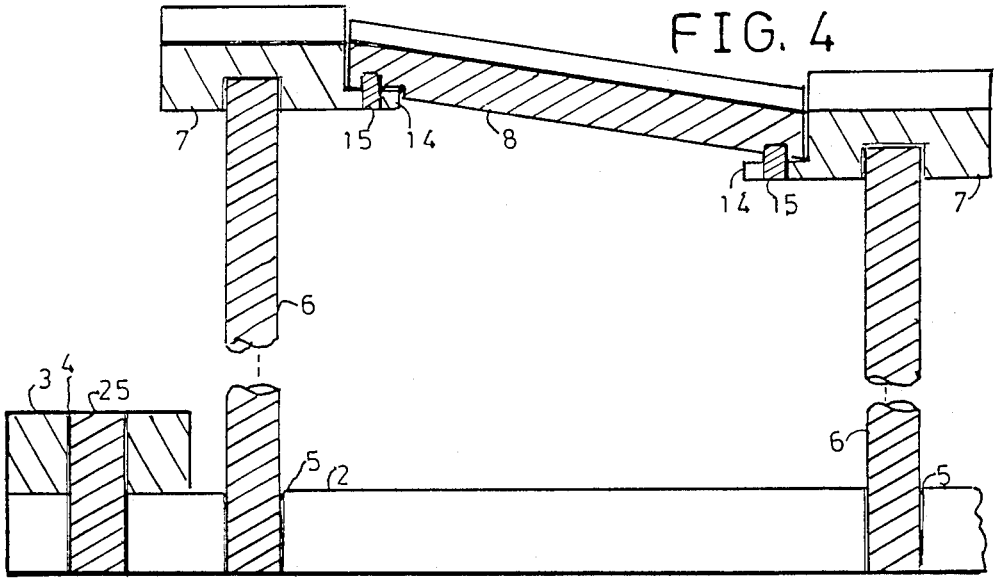
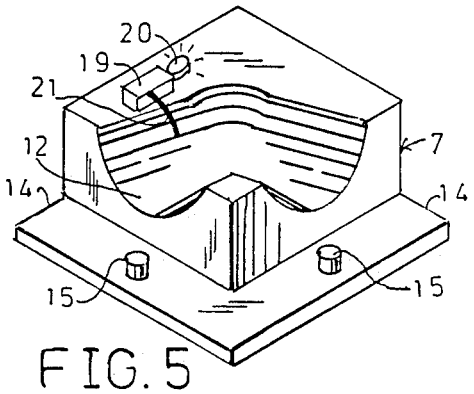
FIG. 5
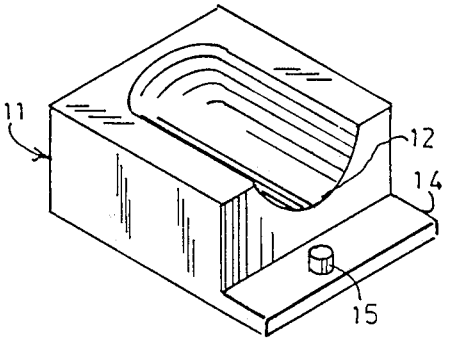
FIG. 6
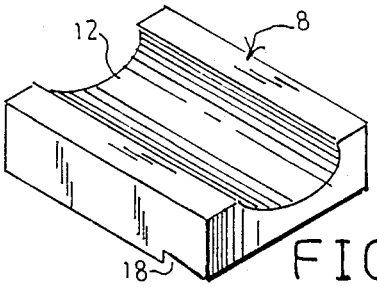
FIG. 7
FIG. 8
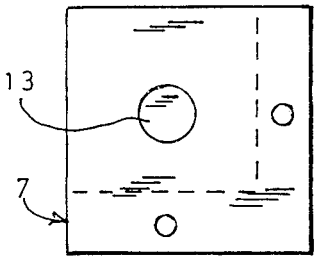

MODULAR ROLLER COASTER TOY

FIELD OF THE INVENTION

The present invention relates to toys and games and more particularly to such toys having a modular track that may be assembled in a variety of orientations to provide diverse grooved downward sloping pathways for rolling balls.

BACKGROUND OF THE INVENTION

Eisenburg in U.S. Pat. No. 4,171,090 issued 10/16/79 teaches an adjustable track formed of two resiliently flexible carriers or track members guided in vertically adjustable bearings in spaced juxtaposition so that a ball may be supported therebetween. The bearings are clamped to vertical rods held in holes in a baseboard. A rolling toy or ball rolls down the track when placed at the highest end. The structure is expensive and assembly requires skills beyond many children.

Bender et al in U.S. Pat. No. 4,553,749 issued 11/19/85 discloses a plurality of toy elongate blocks having an inclined groove along an upper surface. The blocks may be arranged in various vertical and horizontal orientations to form an extended pathway for a rolling ball or marble. The blocks are used in a game with an object to form the longest path for rolling the ball. All of the grooves are straight and the ball must drop from one level to a lower level to reach the groove in the next block. The blocks are piled upon one another to adjust height so the path cannot cross itself.

U.S. Pat. No. 2,000,808 issued 5/7/35 to Williams discloses straight and curved track segments joinable together, with tripod support stands having a notched upper surface for receiving a segment. The segments join together to form a track with a level path and the support stands have varying heights so that the entire path may be tilted at an angle to enable a ball to roll down the track from highest to lowest point. Due to the structure, the slope of the entire track will be uniform and there is no opportunity for the user to vary the slope and thereby the speed of descent of a ball on a portion of the track.

Despite the abundance of rolling ball toys a need has arisen for a rolling ball toy that is sturdy, inexpensive to produce, and easy to assemble by children. Furthermore, the toy should be adaptable to assembly with a great variety of configurations, with a path that can cross over and under itself, provide a slow speed of rolling with ability to vary the slope in different sections.

SUMMARY OF THE INVENTION

It is accordingly an object of the invention to provide an entertaining and amusing as well as educational toy that will teach and encourage manual dexterity and innovation in assembly in a variety of configurations. It is yet another object to provide a toy that teaches comprehension of three dimensional concepts in the most pedagogically effective manner of learning by doing in the real physical world. It is yet another object to provide a toy that is sturdy, easily assembled without tools or skills, and that is economical to fabricate.

The toy of the invention includes: a base having a plurality of vertical holes; a plurality of rods of various lengths for fitting into selected holes in the base; a plurality of corner segments, each having a curved horizontal groove in the upper surface and a vertical hole in the lower surface for receiving the top of a rod; and a plurality of straight segments of various lengths, each having a straight groove in the upper surface. Connecting means are provided for interlocking straight segments to corner segments in such fashion that the grooves line up to form a continuous track for a rolling ball and so that the straight segments are sloping between corner segments which are horizontal.

These and other features, objects and advantages of the present invention will become more apparent when the following detailed descriptions of preferred embodiments of the invention are read in conjunction with the drawings.

BRIEF DESCRIPTION OF THE DRAWINGS

FIG. 1 is a plan view of the base after assembly.

FIG. 2 is a plan view of the completely assembled toy.

FIG. 4 is a sectional view through a portion of FIG. 2 taken on the line 4—4, the same being on a greatly enlarged scale.

FIG. 5 is a perspective view of a corner element.

FIG. 6 is a perspective view of an end element.

FIG. 7 is a perspective view of a short straight element.

FIG. 8 is a bottom view of the corner element of FIG. 5.

FIG. 9 is a side elevation view of the short straight element of FIG. 7.

FIG. 10 is a bottom view of the short straight element of FIG. 7.

Figure 3:
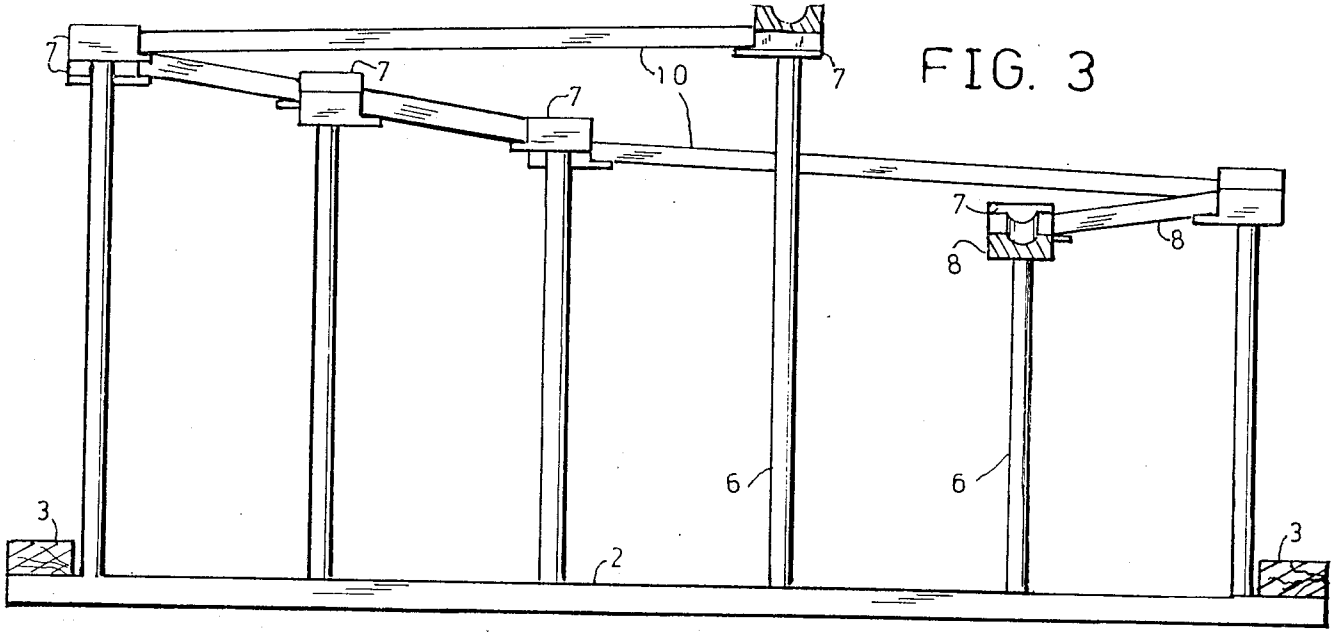
FIG. 3 is a sectional view through FIG. 2 taken on the line 3—3, the same being on an enlarged scale.

DETAILED DESCRIPTION OF A PREFERRED EMBODIMENT.

Referring now first to FIG. 1, the base 1 is assembled from a set of base members 2 laid parallel to one another on a sturdy support such as a floor or table. A pair of connecting members 3 are laid on the base members 2 so that vertical holes 4 on connecting members are aligned with corresponding holes in the ends of base members. Short dowels 25 are inserted into the aligned holes to complete the assembly. The dowel in the aligned holes is best seen in FIG. 4. The connecting members 3 space the base members 2 apart from one another such that the vertical mounting holes 5 in adjacent base members have a center to center distance of four and one-quarter inches. Each base member has a plurality of mounting holes 5 also spaced four and one-quarter inches on center. By simply putting round pegs in round holes, the user assembles a base with holes in both directions at right angles having a uniform spacing for assembly of the track. The toy includes a set of vertical members or dowels 6 having a diameter of three-eights of an inch to fit snugly in mounting holes 5 in base members. The dowels 6 in the set all have different lengths, increasing in increments of one-half of an inch so that when they are inserted in mounting holes 5 of base members 2, the track supported thereon will have a precise slope without requiring adjusting skills or tools. The track components that mount on the vertical members 6, as shown best in FIGS. 3 and 4, include corner elements 7 (FIGS.

Figure 11:
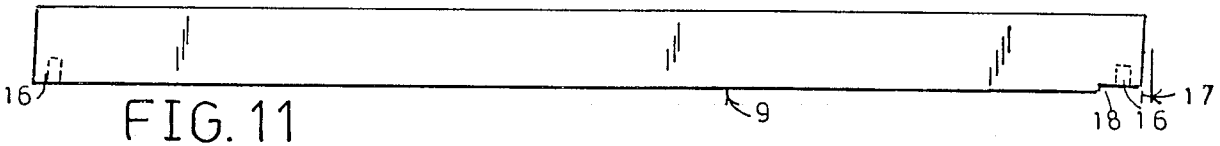
FIG. 11 is a side elevation view of an intermediate straight element.
Figure 12:
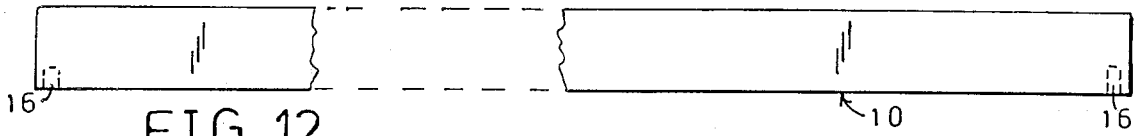
FIG. 12 is a side elevation view of a long straight element.

5 and 6), short straight elements 8 (FIGS. 7, 9, 10), intermediate straight elements 9 (FIG. 11), and long straight elements 10 (FIG. 12). Not essential to operation, but a useful addition is end element 11 (FIG. 6). All of these elements have a groove 12 in their upper surface for receiving a spherical element such as a ball or marble 24 groove 12 in end element 11 does not continue across the entire surface, so that the rolling toy is stopped at the end of its passage.

The corner elements 7 and the end element 11 have a blind, vertical hole 13 in their underside to snugly engage the upper end of a vertical rod 6. When so engaged, the groove in the corner element is horizontal. Extending from the corner element 7 on two sides, and from the end element 11 on one side, a shelf 14 has a vertical peg 15. To assemble a continuous track between two holes 5 in the base 1, two vertical members 6 are selected, one having a length one increment (½ inch) greater than the other. These are fitted into the holes 5 in the base. A corner element is inserted atop each vertical member 6 by inserting the dowel into the hole 13 in the underside of the corner element. The track between the two corner elements is completed by use of one of the straight elements. When the holes 5 are adjacent, a short straight element 8, as best seen in FIG. 4, will just fit between the two corner elements 7, with its ends resting upon the shelves 14, and the vertical pegs 15 fitting into blind holes 16 in the underside of the straight element 8 and the grooves 12 form a continuous path. The vertical ends of straight element 8 are cut at an angle 17 of ten degrees from the vertical and an undercut 18 on the underside at the upper end is also at a ten degree angle so that the upper end fits snugly on the shelf of the higher corner element and provides a slope of ten degrees between the two corner elements. The blind hole 16 also has this same angle.

When the distance between vertical members 6 is increased by one hole space, i.e. a distance of 8½ inches, the intermediate straight element 9 is used to span the space between corner elements, and the angle 17 is 4 degrees, because the same drop in elevation occurs over a greater distance. When the distance between vertical members 6 is increased by another hole space, i.e. to 12¾ inches, the long straight element 10 is used to span the space between corner elements. Because the slope will then be so shallow, it is not necessary to use an angle or undercut. Therefore the ends and the hole 16 are at ninety degrees to the horizontal as best seen in FIG. 12. At every corner element the path of the track changes ninety degrees, and the direction can be selected to left or right as desired. FIG. 2 illustrates but one of many possible arrangements that can be selected. When a short element 8 is selected, the slope is greatest, and the ball falls at its greatest velocity. When a long element 10 is selected, the slope is least and the ball 24 falls at its least velocity. Furthermore, the path is horizontal at each corner element that slows the ball so that there can be a variety of velocities selectable as well as path configurations. The path, as shown in FIGS. 2, 3 can be quite complex and cross over and under itself at different levels. This gives a great sense of satisfaction and accomplishment when the assembly is completed and the ball rolls down the path. Because of the slowing at every corner element, the ball can roll for an extended period of time to add to the enjoyment. Although the final result may be quite complex, assembly is simple. The three sizes of straight segments have lengths of 3 inches, 7¼ inches and 11½ inches to span exactly the space between corner segments that are on vertical members in holes in the base that are one, two or three hole spaces (4¼ inches) apart, respectively. There is no need for careful adjustment or measurement required because all of the segments are modular and arranged to fit the hole spacings exactly.

Optionally, the battery operated sensor assembly 19 shown in FIG. 5 may be installed that is actuated whenever a ball rolls past microswitch 21. The sensor 19 energizes emitter 20 that may emit sound and/or light to increase the enjoyment of the completed assembly. The end segment 11 may be used in place of a corner segment at the highest and lowest end of the track. It also has a blind hole in the underside (not shown) for fitting on a vertical member.

As shown in FIG. 2, the lower end may terminate in a bowl-shaped container 22. If this is positioned eccentrically as shown, the balls or marbles will swirl around inside the bowl before stopping. An additional advantage of the structure is that it may be readily expanded by interdigitating one or more additional bases with the new base members 23 (shown in phantom in FIG. 1) between the old base members 2.

A further advantage of the structural design is that all of the components may be made from wood, and the toy, when disassembled fits readily into a compact space. Optionally, some or all of the components may be made of other materials such as plastic.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

Such changes may include, for example, providing horizontal segments with connecting means at opposed ends for connecting two straight sloping elements in a straight horizontal path or sloping elements with a non-straight track formation for increased diversity.

I claim:

1. A rolling coaster device providing a trackway for a trackborne toy, the course of said trackway in both vertical and horizontal plane being variable by increments of fixed distances, said device comprising:

(a) a plurality of elongate vertical members of unequal lengths having lengths varying from one another by multiples of a fixed distance;

(b) base means adapted for resting said device upon a support surface, said base means having a plurality of vertical holes for receiving the lower ends of said vertical members of unequal lengths, said holes spaced apart from one another by multiples of a fixed distance in at least two horizontal directions;

(c) a plurality of horizontal elements, each having a horizontal track formation in the top for providing a rolling path for said toy, a substantially vertical hole in its underside for receiving the upper end of one of said vertical members, and having a connecting means affixed to at least one of its sides;

(d) a plurality of elongate sloping elements having two long sides and two ends and having a horizontal-element-engaging means at each of said ends for removably engaging one of said horizontal elements at said connecting means, each of said sloping elements having a track formation in its top that slopes when assembled and that aligns with the track formation of each of said horizontal elements when engaged; and wherein said horizontal track formation in each of said horizontal elements is disposed substantially parallel to said support surface and said track formation in each of said sloping elements is disposed at an incline to said support surface when engaged.

2. The device according to claim 1, in which said horizontal elements include corner elements having said connecting means at two sides at right angles to each other and said track formation in its top causes the path of said toy to turn through an angle of substantially ninety degrees.

3. The device of claim 2, in which said base means has holes in two directions that are at an angle to each other of substantially ninety degrees.

4. The device according to claim 3, in which said sloping elements have varying lengths to span between said horizontal elements when installed on said vertical members at said multiples of said fixed distance on said base.

5. The device according to claim 4, in which said base means comprises:

a plurality of horizontal members having a set of spaced vertical holes for receiving said vertical members and connector engaging means at each end; and a pair of elongate connectors having a plurality of spaced apart connecting elements for engaging said horizontal members and spacing said horizontal members apart by said fixed distance in said horizontal plane.

6. The device according to claim 5, in which said horizontal elements includes at least one end element having a track formation that stops the passage of said toy.

7. The device according to claim 6, made substantially of wood.

8. The device according to claim 5 including interdigilating means for combining said base means with at least one additional base means.

9. The device according to claim 1, further including toy sensing means for affixing to said track formation for sensing the passage of said toy and emitter means connected to said sensing means for emitting a sensible signal when said sensing means senses the passage of said toy.

10. The device according to claim 1, made substantially of wood.

11. The device according to claim 1, in which said toy is a sphere and said track formation is a curved groove formed in the upper surface of said horizontal elements and said sloping elements.

12. The device according to claim 1, in which said connecting means on said horizontal elements includes shelf and vertical peg means.

13. A device for guiding a rolling toy from a high elevation to a low elevation that provides user-selectable and variable horizontal and vertical pathways for said rolling toy, said device comprising:

(a) a base having a plurality of spaced apart vertical holes in its upper surface;

(b) a plurality of elongate vertical members of various lengths each having a first end constructed to fit into said vertical hole in said base;

(c) a plurality of horizontal elements, each having a horizontal track formation in the top for guiding said rolling toy a substantially vertical aperture in the underside for fitting onto a second end of said vertical member when said first end is engaged in said base, and connecting means on two sides;

(d) a plurality of elongate sloping elements, each having a track formation in the top for guiding said rolling toy and a horizontal-element-engaging means at opposite ends, said horizontal-element-engaging means removably engaging said connecting means on at least one of said horizontal elements, wherein said track formation on at least one of said sloping elements forms a continuous path with discontinuous elevations with said track formation on said horizontal elements at each end of said one of said sloping elements; and wherein said horizontal track formation in each of said horizontal elements is disposed substantially parallel to said support surface and said track formation in each said at least one sloping element is disposed at an incline to said support surface when engaged.

14. The device according to claim 13, in which said horizontal elements includes corner elements in which said track formation provides an arcuate path for said rolling toy and in which said connecting means are located on two adjacent sides substantially at right angles to one another.

15. The device according to claim 14, in which said vertical holes in said base are arranged in parallel rows and in columns substantially at right angles to said rows and in which said holes are spaced apart a uniform distance.

16. The device according to claim 15, in which said vertical members have lengths which differ from one another by multiples of a fixed distance.

* * * * *